US006151844A

United States Patent [19]

Kovachevich

[11] Patent Number: 6,151,844

[45] **Date of Patent: *Nov. 28, 2000**

[54] RELATIVE GRAVITY OF STRUCTURES

[75] Inventor: Lazar S Kovachevich, New York City, N.Y.

[73] Assignee: Lazar's Engineering, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/815,533

[22] Filed: Mar. 12, 1997

[51] Int. Cl.[7] ..... E04B 1/92; E04H 9/14

[52] U.S. Cl. ..... 52/167.1; 52/92.2; 52/223.6; 52/223.14; 52/295; 52/741.3

[58] Field of Search ..... 52/92.2, 167.3, 52/295, 223.6, 223.7, 223.14, 167.1, 741.3

[56] References Cited

U.S. PATENT DOCUMENTS

| | | | |
|---|---|---|---|
| 5,384,993 | 1/1995 | Phillips | 52/295 X |
| 5,448,861 | 9/1995 | Lawson | 52/295 X |
| 5,491,935 | 2/1996 | Coxum | 52/295 X |
| 5,535,561 | 7/1996 | Schuyler | 52/92.2 X |
| 5,570,549 | 11/1996 | Lung et al. | 52/295 |
| 5,765,333 | 6/1998 | Cunningham . | |

*Primary Examiner*—Robert Canfield

[57] ABSTRACT

A construction modification and associated method used in pre-stressed building structures is designed to enhance resistance to extreme high wind environments, such as hurricanes and tornadoes, and in earthquake prone regions is most useful for structures built of lightweight materials such as wood or aluminum but is also applicable to structures built of heavy materials such as brick, stone, concrete, reinforced concrete and steel. Modifications include increased spacing of the wall frame elements, namely wall studs or columns, symmetrical sheeting at both sides of the frame when wood is used to build wall panels or symmetrical building of walls inside the frame when heavy material as brick, concrete block, stone, cast concrete etc. are used to build panels, a new incorporated into structures is complement system of strings and balance beams and modification of the effective weight or gravity of the structure. The strings of the complement system are placed in channels running through the wood studs of wood wall panels (or columns of the frame system or massive walls if other heavy materials herein mentioned are used) and a balance beam is placed at the top of the walls of each story. A pre-stressing forces are supplied to the strings at the top of each story by a hydraulic devices or other mechanical means in direction coinciding with the direction of the structure's natural gravity. The balance beam distributes applied forces uniformly on the walls. The additional energy in the wall structure, called relative gravity, eliminates problems associated and caused by wind loads and seismic loads including intense vibration of walls, tension and uplift forces in structure, structure's instability and the other modifications eliminates the presence of anemic connectors and fasteners as the means in prior art for load transfer throughout the structure.

14 Claims, 16 Drawing Sheets

FIG. 3
(PRIOR ART)
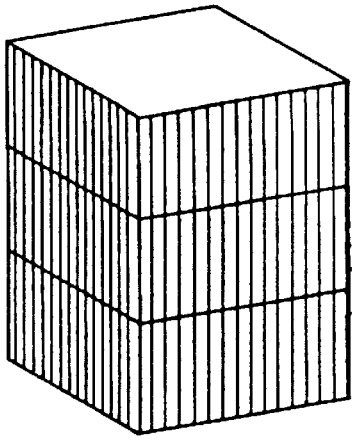
FIG.5
(PRIOR ART)
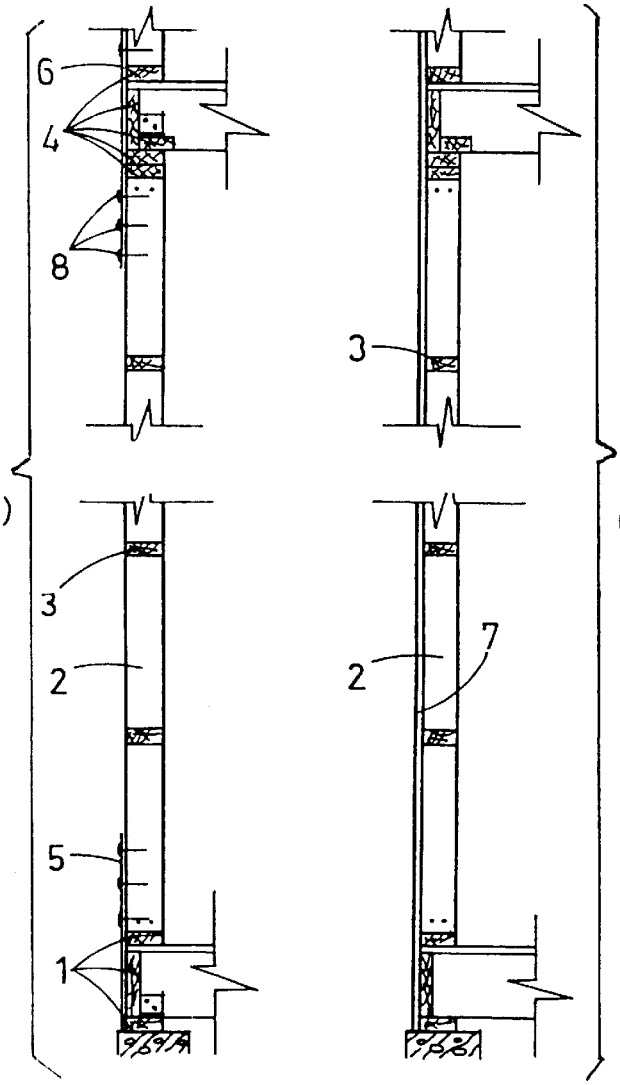
FIG.6
(PRIOR ART)

TABLE NO. 1 (PRIOR ART)

| i POINT | WIND SPEED V | WIND LOAD Pw | OVERTURNING MOMENT M | GRAVITY RESULT Gmin | GRAVITY DISPLACEM'T EGri | |
|---|---|---|---|---|---|---|
| | M P H | KN/M2 | KNM | TONS(KN) | M | FT |
| 0 | 1 | 2 | 3 | 4 | 5 | 6 |
| 1 | 130 | 4,90 | 1969 | 30,6 (306) | 6,43 | 21,08 |
| 2 | 170 | 6,56 | 2900 | | 9,48 | 31,08 |
| 3 | 200 | 8,14 | 3600 | | 11,75 | 38,52 |
| 4 | 250 | 10,77 | 4750 | | 15,52 | 38,52 |
| 5 | 300 | 12,38 | 5921 | | 19,35 | 63,44 |

TABLE NO. 2 (PRIOR ART)

| CASE | WIND SPEED V | WIND LOAD $P_W$ | DISPLACEMENT Un | | ALLOW. DISP'T | | WALL UNIT |
|---|---|---|---|---|---|---|---|
| | | | $Un=\frac{5}{384}\cdot\frac{P_W H^4}{E\,1}=1,27P_W$ | | $U_{allow.}=\frac{H}{360}$ | | |
| n | MPH | KN/M | CM | IN | CM | IN | |
| 0 | 1 | 2 | 3 | 4 | 5 | 6 | 7 |
| 1 | 130 | 1,99 | 2,54 | 1,00 | 0,85 | 0,33 | GYP. WBD. |
| 2 | 170 | 2,66 | 3,38 | 1,33 | | | |
| 3 | 200 | 3,30 | 4,19 | 1,65 | | | |
| 4 | 250 | 4,30 | 5,55 | 2,19 | | | |
| 5 | 300 | 5,03 | 6,38 | 2,51 | | | |

FIG. 9
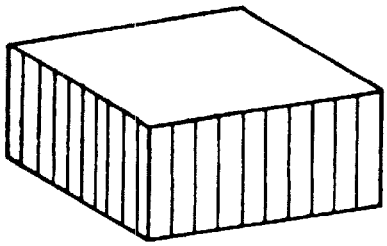
FIG. 10
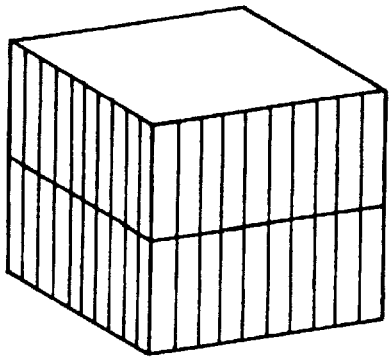
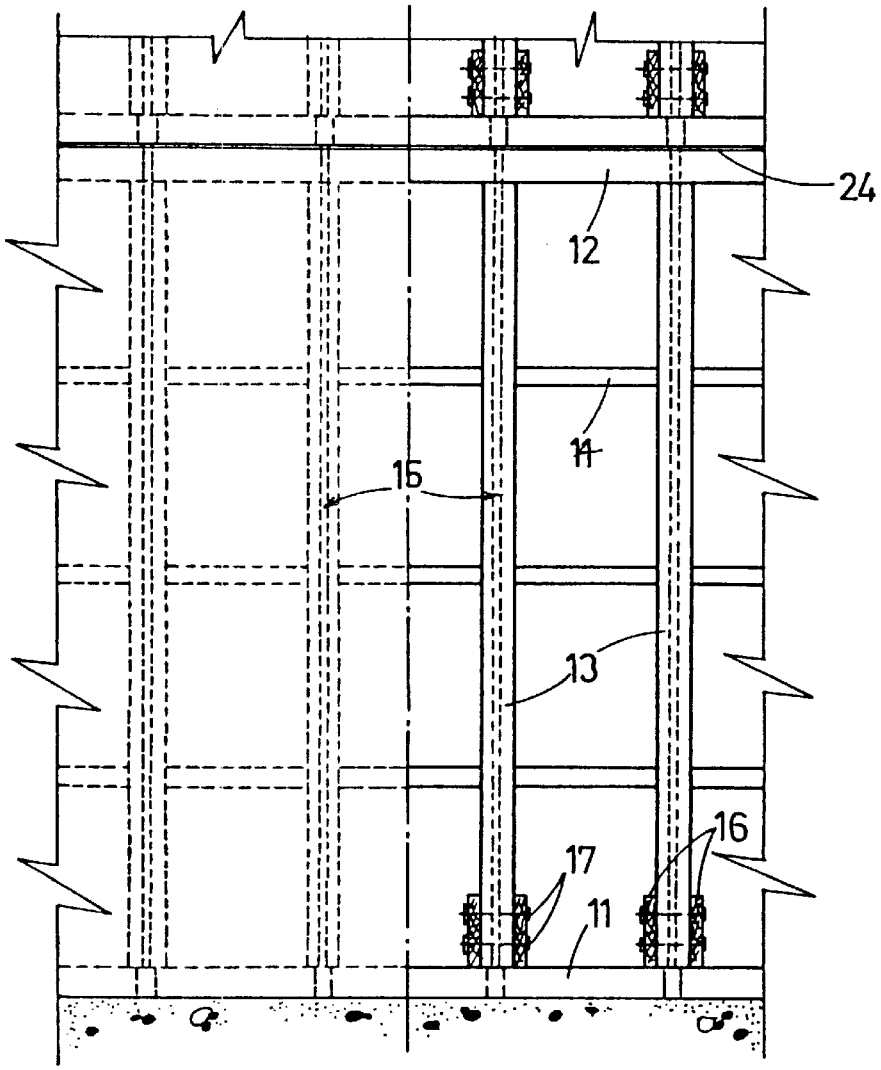
FIG. 12

TABLE NO. 3

| i POINT | WIND SPEED V | WIND LOAD $P_W$ | OVERTURNING MOMENT M | GRAVITY RESULT Gr | GRAVITY DISPLACEM'T $E_{Gri}$ | |
|---|---|---|---|---|---|---|
| | MPH | $KN/M^2$ | KNM | TONS(KN) | M | FT |
| 0 | 1 | 2 | 3 | 4 | 5 | 6 |
| 1 | 130 | 4,90 | 1969 | 200(2000) | 0,98 | 3,21 |
| 2 | 170 | 6,56 | 2900 | 250(2500) | 1,16 | 3,80 |
| 3 | 200 | 8,14 | 3600 | 300(3000) | 1,20 | 3,93 |
| 4 | 250 | 10,77 | 4750 | 400(4000) | 1,18 | 3,86 |
| 5 | 300 | 12,38 | 5921 | 500(5000) | 1,18 | 3,86 |

TABLE NO. 4

| CASE | WIND SPEED V | WIND LOAD $P_W$ | DISPLACEMENT Un | | ALLOW. DISP'T | | WALL UNIT |
|---|---|---|---|---|---|---|---|
| | | | $Un = 0{,}085(P_W - P_{rg})$ | | $U_{allow.} = \frac{H}{360}$ | | |
| n | MPH | KN/M' | CM | IN | CM | IN | |
| 0 | 1 | 2 | 3 | 4 | 5 | 6 | 7 |
| 1 | 130 | 2,99 | 0,13 | 0,05 | 0,85 | 0,33 |  |
| 2 | 170 | 4,00 | 0,16 | 0,06 | | | |
| 3 | 200 | 4,96 | 0,18 | 0,07 | | | |
| 4 | 250 | 6,57 | 0,26 | 0,10 | | | |
| 5 | 300 | 7,55 | 0,29 | 0,11 | | | |

TABLE NO. 5

| CASE | WIND SPEED V | WIND LOAD PW | DISPLACEMENT Un | | ALLOW. DISP'T | | WALL UNIT |
|---|---|---|---|---|---|---|---|
| | | | $Un=\frac{5}{384}\cdot\frac{Pw(\frac{2}{3}H)^4}{EI}=0{,}016\,Pw$ | | $Uallow.=\frac{H}{360}$ | | |
| n | M P H | K N/M | CM | IN | CM | IN | |
| 0 | 1 | 2 | 3 | 4 | 5 | 6 | 7 |
| 1 | 130 | 2,99 | 0,05 | 0,02 | 0,85 | 0,33 |  |
| 2 | 170 | 4,00 | 0,06 | 0,02 | | | |
| 3 | 200 | 4,96 | 0,08 | 0,03 | | | |
| 4 | 250 | 6,57 | 0,10 | 0,04 | | | |
| 5 | 300 | 7,55 | 0,12 | 0,05 | | | |

RELATIVE GRAVITY OF STRUCTURES

BACKGROUND OF INVENTION

This invention involves a method and its associated building support structures for the modification and improvement of building construction, in particular for the modification of the construction of buildings with respect to resistance to strong winds and earthquakes in earthquake prone regions.

This invention is especially directed to, although not exclusively directed to, residential and office buildings that are composed of and are built using standardized structural elements and units that as wall units, floor units and roof units, that are constructed of lightweight material as well as of heavy weight material.

For buildings that are located in areas in which "high wind(s)" occur, designed herein as wind speeds of 130 to 350 miles per hour("mph"), it is essential that the building be constructed so that it is capable of resisting such wind speeds without being damaged or destroyed. It should be noted that wind speeds of 130 to 350 mph occur in hurricanes, thunderstorms and tornadoes. Accordingly, structures in any location subjected to such weather, including North and South America, South Asia, the Far East, Australia and Western Europe, need to be designed to withstand high winds.

Accordingly, in the earthquake prone regions building structures should be resistant against powerful earthquakes regardless what material they are built of. But as evidences show, collected from the earthquakes happened in the past throughout the world, where building structures are constructed of a various materials(lightweight, heavyweight or materials having a various degree of a strength), no building structures have displayed capability to withstand forces induced by earthquakes without being subjected to a severe damage or destruction.

A structure's ability to withstand high wind is primarily related to its weight, which is referred herein as the "natural gravity" of the structure. Accordingly, lightweight materials, such as wood, used in construction of dwelling houses and offices, are most vulnerable to damage caused by high wind since generally have relatively small resistance to high wind, everything else being equal. In fact, many structures constructed in the United States are made of wood and other lightweight materials and therefore are vulnerable to high wind. When such lightweight structures are subjected to high wind, their weight becomes extremely small and easy moveable by the horizontal force.

The term "relative gravity" of a structure as used herein refers to the additional force of weight of the structure generated by mechanically applying pre-stressing forces in the direction of the force of the structure's natural gravity. However, the "relative gravity" force does not affect the soil or other matter beneath the structure by adding forces on the soil; it is accumulated and distributed entirely within the structure itself.

Based on a large scale study that has examined the effects of high wind conditions having speeds of 130, 170, 200, 250, 300 and 350 mph on one, two and three-story structures, when such structures used as a dwelling house or an office structure are subjected to high wind, the structural consequences are as follows:

1. The gravity resultant of the structure is displaced from its natural position in direct proportion to the intensity of the wind speed. This causes severe disturbances in the structure's ability to withstand stress and is most evident in the walls of the structure.

2. High winds can change speeds suddenly. Walls of known structures have low, almost negligible transverse (flexural) stiffness as well as low, almost negligible inertial mass. When subjected to high wind such wall undergo vibrations. Walls that undergo vibrations develop additional load and transfer such additional load to the system of connectors and fasteners. In addition, structural units are composed of structural elements which are classified as primary, secondary and tertiary. It is said that secondary and tertiary elements are subjected to vibrations from multiple sources. As a result, the structure undergoes chaotic vibrations.

3. As a result of the above effects of high winds on the structure, the structure collapses.

Actual experience has verified the conclusion of such study in that the structure would indeed collapse under high wind conditions. In particular, hurricane Andrew which had wind speed of 164 mph and gust wind speeds of 198 mph on Aug. 24, 1992 when it struck South Florida, hurricane Opal which struck in 1995, and many other hurricanes and tornadoes had sufficient wind speeds to cause great damage to structures along their paths. In the earthquake prone regions existing wood structures may have better rating, means the wood structures ability to withstand seismic load is greater than its ability to resist high wind attacks, because seismic load induced on the structure by earthquake is function of gravitational mass and inertial mass of the structure. Meanwhile developed vibration inside structural units produces significant additional load on the system of anemic connectors and fasteners throughout the wood structure. These are reasons the collapses in the structures are along joint lines of the structural units: in the roof structure, wall structure, joint lines of wall units-roof units, joint lines of wall units-floor units.

Effects of an earthquakes in terms of a developing loads on the building structures constructed by heavyweight classical materials, such as brick, stone, reinforced concrete, steel, etc. are of much greater degree in comparison with wood structures due to much greater gravitational mass of those materials. Despite high strength of those materials, every earthquake of a greater intensity in the past have produced catastrophic damages to the buildings. A fresh example is Northridge earthquake which five years ago made huge damages to about 100 toll buildings in the Los Angeles area built of steel and reinforced concrete.

This invention is designed to address and solve the above problem caused when structures made of lightweight materials are subjected to high winds and earthquakes in the earthquake prone regions.

This invention is also designed to help in certain degree to solve the problem caused when structures built of heavyweight materials such as brick, stone, concrete block, reinforced concrete, steel, etc. are subjected to seismic load in the earthquake prone regions.

BRIEF SUMMARY OF THE INVENTION

This invention is directed to a modified structures of an American dwelling houses as well as to that of office buildings built of lightweight materials such as wood as well as to the structures built of heavyweight materials such as brick, concrete, steel etc. The subject of a present invention is to provide the structures with sufficient strength to withstand the maximum wind speeds occurring in nature (i.e. hurricanes, tornadoes etc.) that have occurred in the past and are expected to in the future as well as the strength to withstand seismic loads caused by the forces set in motion by maximum earthquakes in earthquake-prone regions of the world. Such strength would be provided in accordance with the present invention in proportion to the particular coefficient of safety desired. As more fully described in the "Detailed Description of the Present Invention", the present invention accomplishes this by means of:

1. Structural modification of the existing prior art structures,
2. Static and dynamic modification of the existing structures,
3. Incorporation of new complement structural components, and
4. Modification of the gravity of the existing structures.

BRIEF DESCRIPTION OF THE DRAWINGS

FIG. 3 is a schematic representation of a prior art three-story structure showing frame system.

FIG. 5 is a cross-sectional view of the wall of prior art FIGS. 1–3 showing the frame system, the system of connection 5,8 and the floor joist 6 connection with the wall structure.

FIG. 6 is a cross-sectional view of the wall of prior art FIGS. 1–3 having plywood sheeting 7 over the frame.

Figure 7:
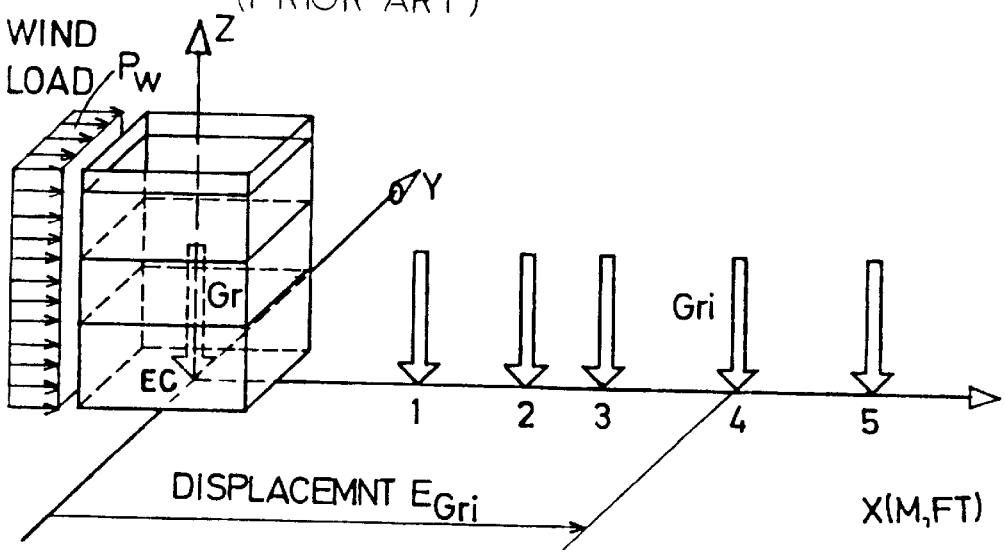
FIG. 7 (PRIOR ART)
FIG. 7 is a graphic illustration of the effect of wind load on the prior art three-story structure as measured by different wind speeds of 130,170,200,250 and 300 mph. The horizontal("X") coordinate (abscissa) measures the displaced gravity of the structure from its natural position at points 1,2,3,4 and 5 respectively.

TABLE NO.1 is a numerical representation of the wind forces at work relating to FIG. 7. The values in columns 5 and 6 indicate in meters and feet respectively the gravity displacement by the wind at the speeds given in column 1.

Figure 8:
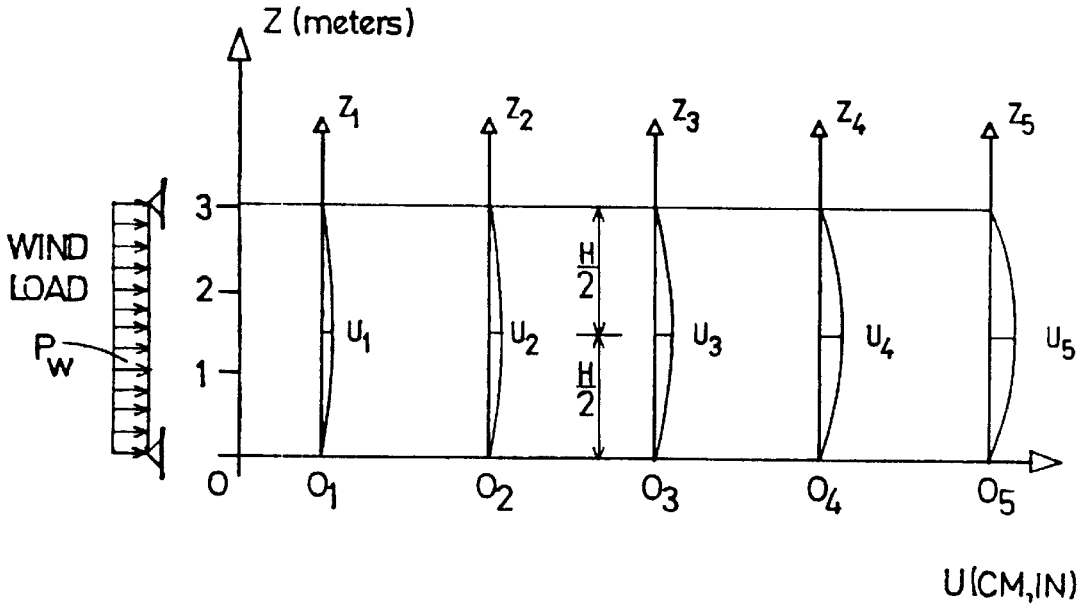
FIG. 8 (PRIOR ART)

FIG. 8 illustrates the amount of wall deflection under wind load due to a given wind speed for the prior art three story structure.

TABLE NO.2 shows sizes of prior art wall deflections. Columns 3 and 4 show amplitudes of the wall displacement in centimeters and inches respectively for the corresponding wind speeds.

Figure 1:
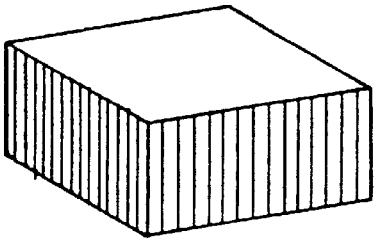
FIG. 1 (PRIOR ART)
FIG. 1 is a schematic representation of a prior art one-story structure showing frame system.

FIG. 9 is a schematic representation of a one-story structure of the present invention showing a frame system having greater spacing than the prior art FIG. 1.

Figure 2:
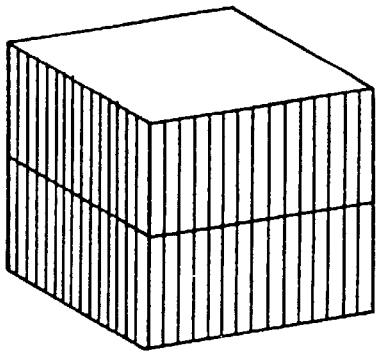
FIG. 2 (PRIOR ART)
FIG. 2 is a schematic representation of a prior art two-story structure showing frame system.

FIG. 10 is a schematic representation of a two-story structure of the present invention showing a frame system having greater spacing than the prior art FIG. 2.

Figure 11:
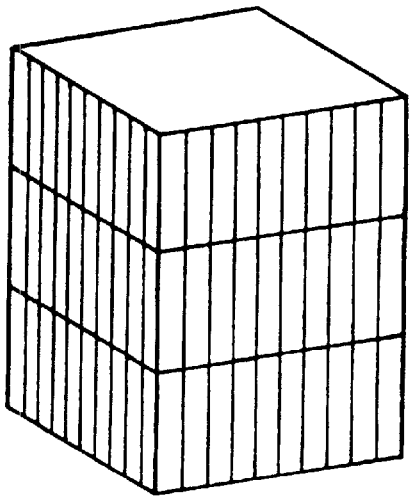

FIG. 11 is a schematic representation of a three-story structure of the present invention showing a frame system having greater spacing than the prior art FIG. 3.

FIG. 12 is a fragmentary view of the wall system of the structures of FIGS. 9–11 with half covered by plywood sheeting and half having the plywood sheeting removed and allowing a view to the frame system 11,12,13,14 and 24. Joists in pairs 16 of the floor structure are seen bonded to the wall wood studs by bolts 17.

Figure 13:
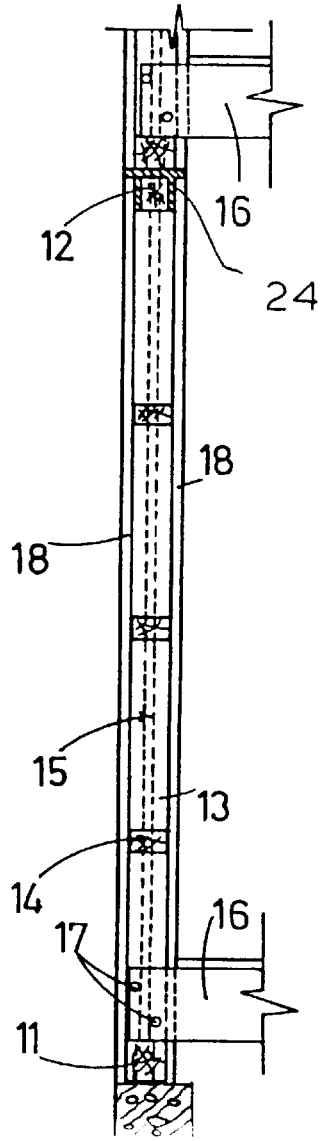

FIG. 13 is a cross-sectional view of the wall system of the structures of FIGS. 9–11 having channels 15 in the vertical elements of the frame and steel balance beams 24 at the top of the wall or panel. The connection of the wall and floor structure is accomplished by full overlap of studs 13 by pair of floor joist 16 and bonded by bolts 17.

Figure 14:
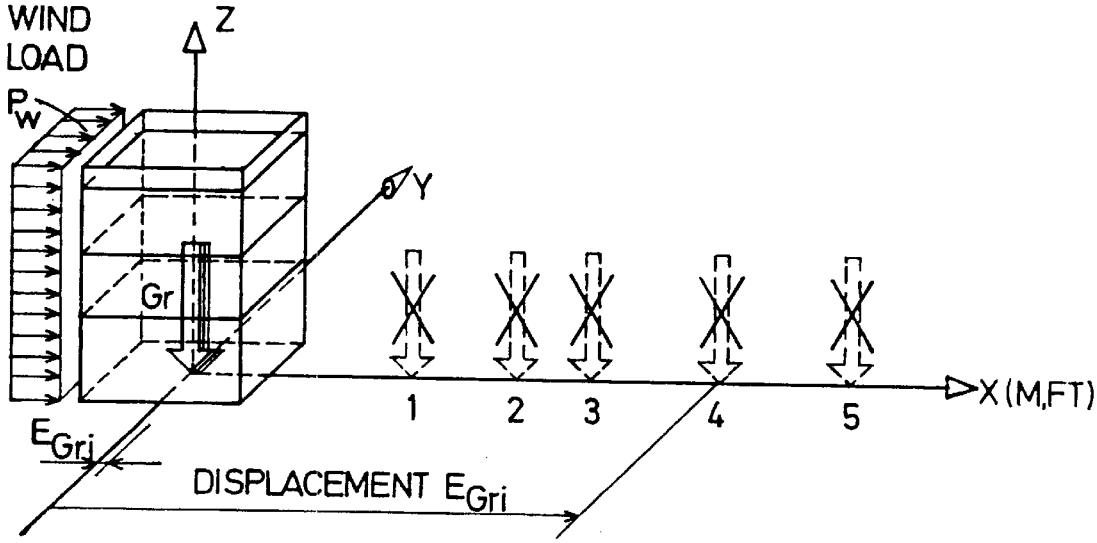

FIG. 14 is a graphic illustration of the work done by the applied gravity force resultant (made up of the natural gravity force of the structure and the applied "relative gravity" force) The displacement of the gravity of the tree-story structure of FIG. 7 at points 1,2,3,4 and 5 is eliminated and the gravity of the structure remains in its natural position. TABLE NO.3 depicts the efficiency of the work associated with the "relative gravity" force. In this table, the natural gravity or weight of the structure is not included. Column 4 of TABLE NO.3 shows relative gravity forces in tons and kN. Columns 5 and 6 show negligible gravity displacements for the corresponding wind speeds and loads given in columns 1 and 2 respectively.

Figure 15:
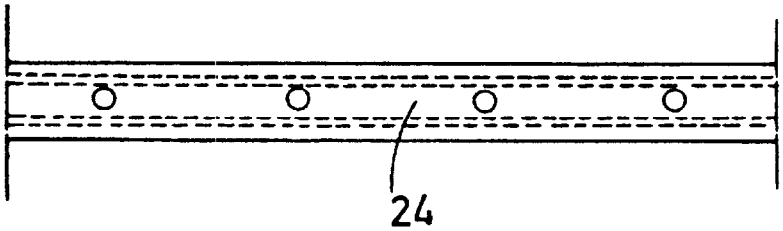

FIG. 15 is a fragmentary horizontal view of the complementary system of wall structure showing balance beam 24.

Figure 15A:
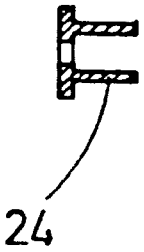

FIG. 15A is a fragmentary cross-sectional view of the complementary system of wall structure showing balance beam 24.

Figure 16:
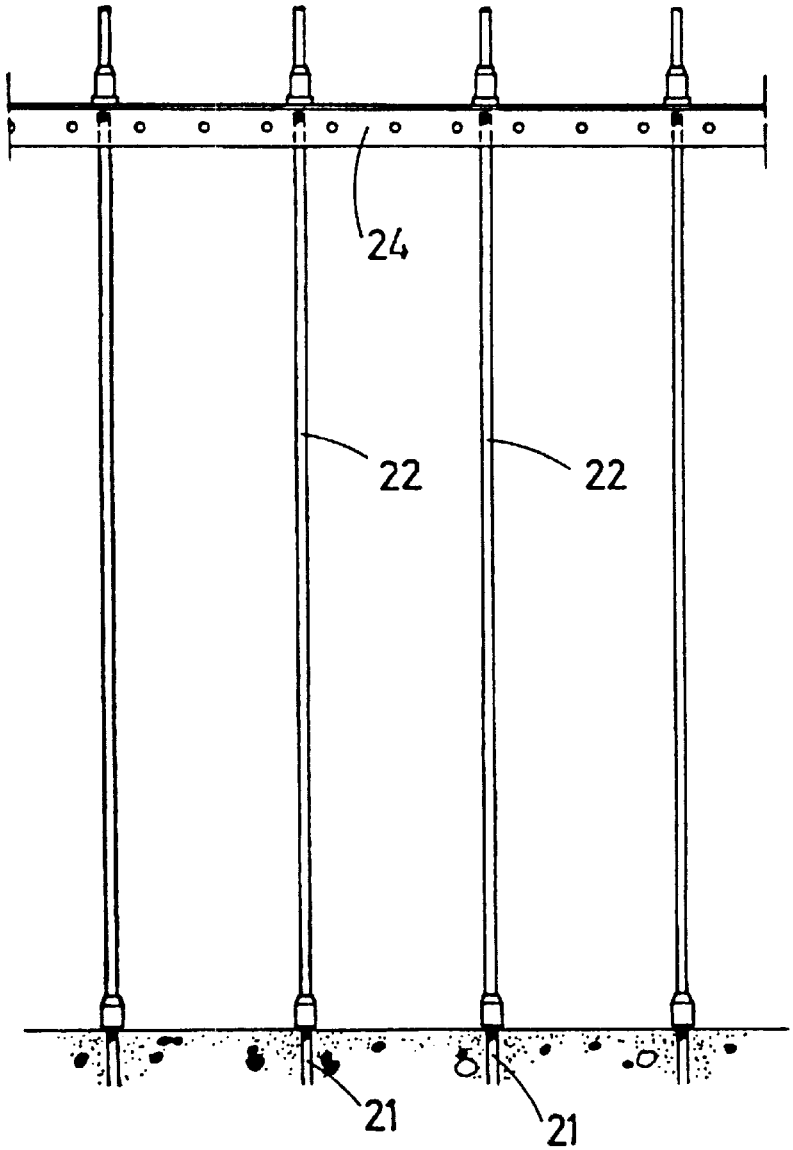

FIG. 16 is a front view of the complementary system of wall structure showing string anchoring 21, strings 22 and balance beam 24.

Figure 17:
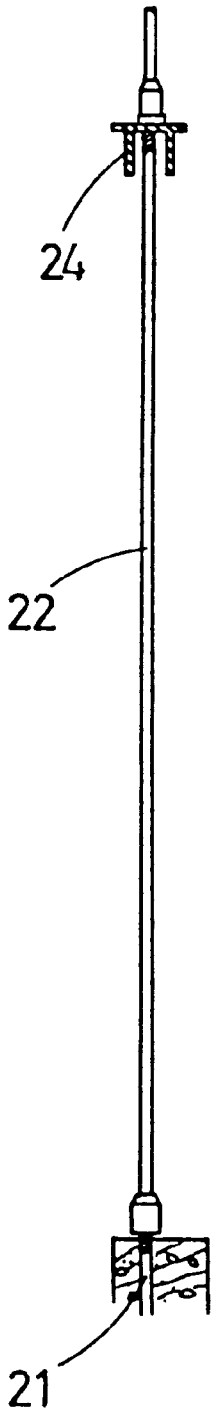

FIG. 17 is fragmentary side view of the complementary system of wall structure showing string anchoring 21, strings 22 and balance beam 24.

Figure 18:
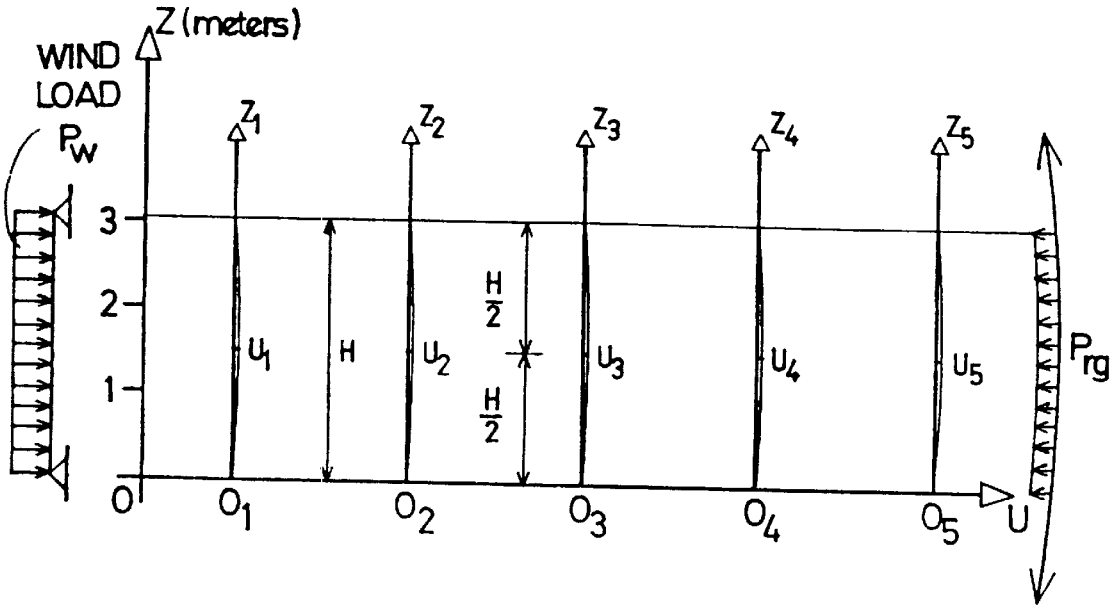
Figure 18:
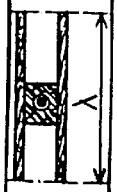

FIG. 18 graphically illustrates for structures of the present invention the degree of wood wall deflection at given wind speeds caused by a given wind load and relative gravity load.

TABLE NO.4 shows numerical values for the amplitudes of displacement of the wood wall of the present invention considered as a simple beam. Columns 3 and 4 represent actual displacement. Columns 5 and 6 represent allowable displacement.

Compare the displacements of TABLE NO.4 for structures of the present invention with the displacements of TABLE NO.2 for structures of the prior art.

Figure 19:
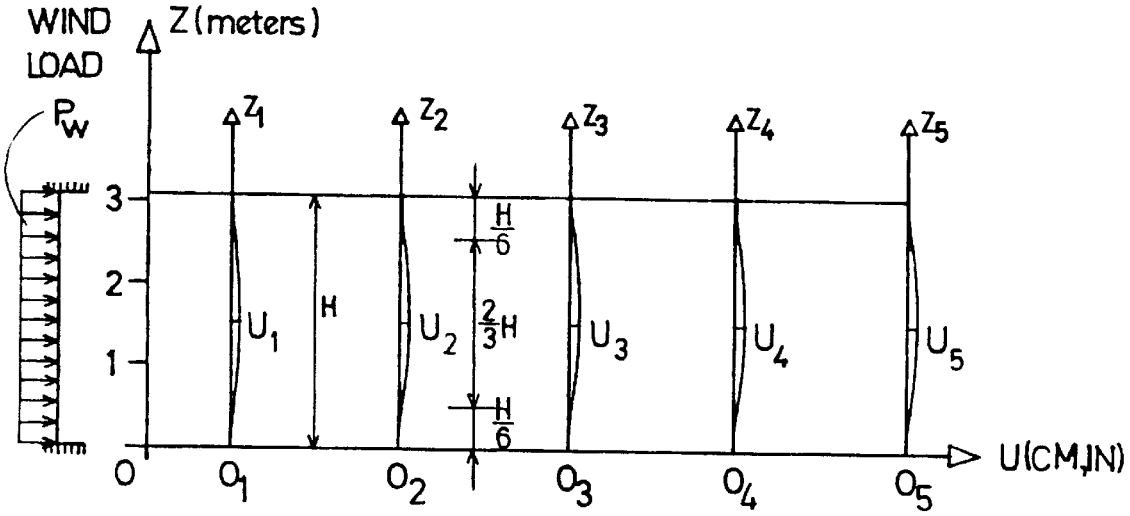
Figure 19:
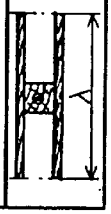

FIG. 19 illustrates wood wall behavior in vibration mode when the wood wall of the present invention is considered as an elastic wall clamped (and hence fixed) at its bottom and top.

TABLE NO.5 shows numerical values for the amplitudes of displacement of the wall of the present invention considered as an elastic wall clamped (and hence fixed) at its bottom and top. Columns 3 and 4 represent actual displacement.

Figure 20:
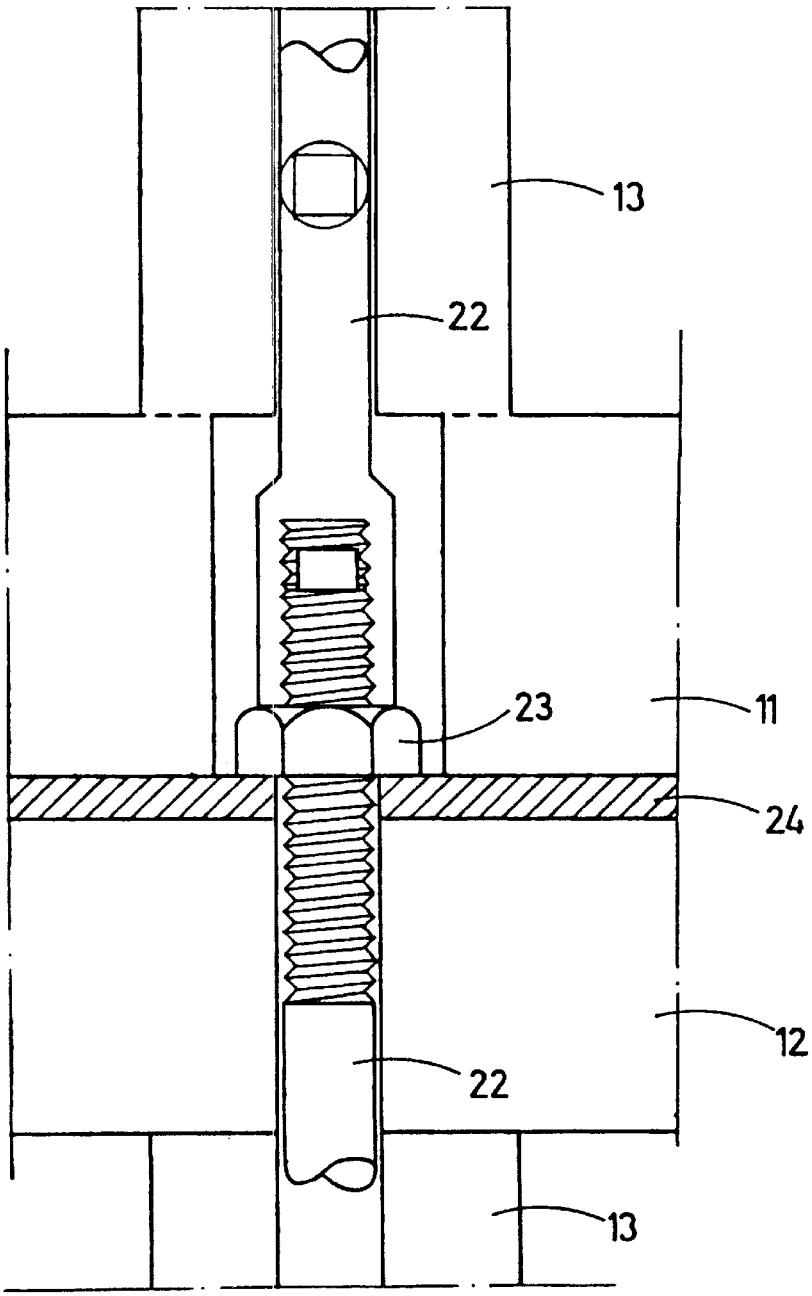

FIG. 20 shows an enlarged fragmentary view of string 22 of the present invention and its continuation to an upper story wall.

The top of the thread of the string 22 at the top of the wall of each story is squared off(i.e. flat) in order to be set counter to the torque holder during gravity force application operation, i.e. pre-stressing.

Figure 21:
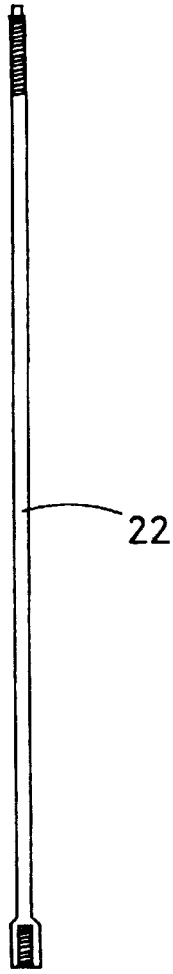

FIG. 21 shows a front view of string 22 of the present invention and its continuation to an upper story wall.

Figures 22, 23:
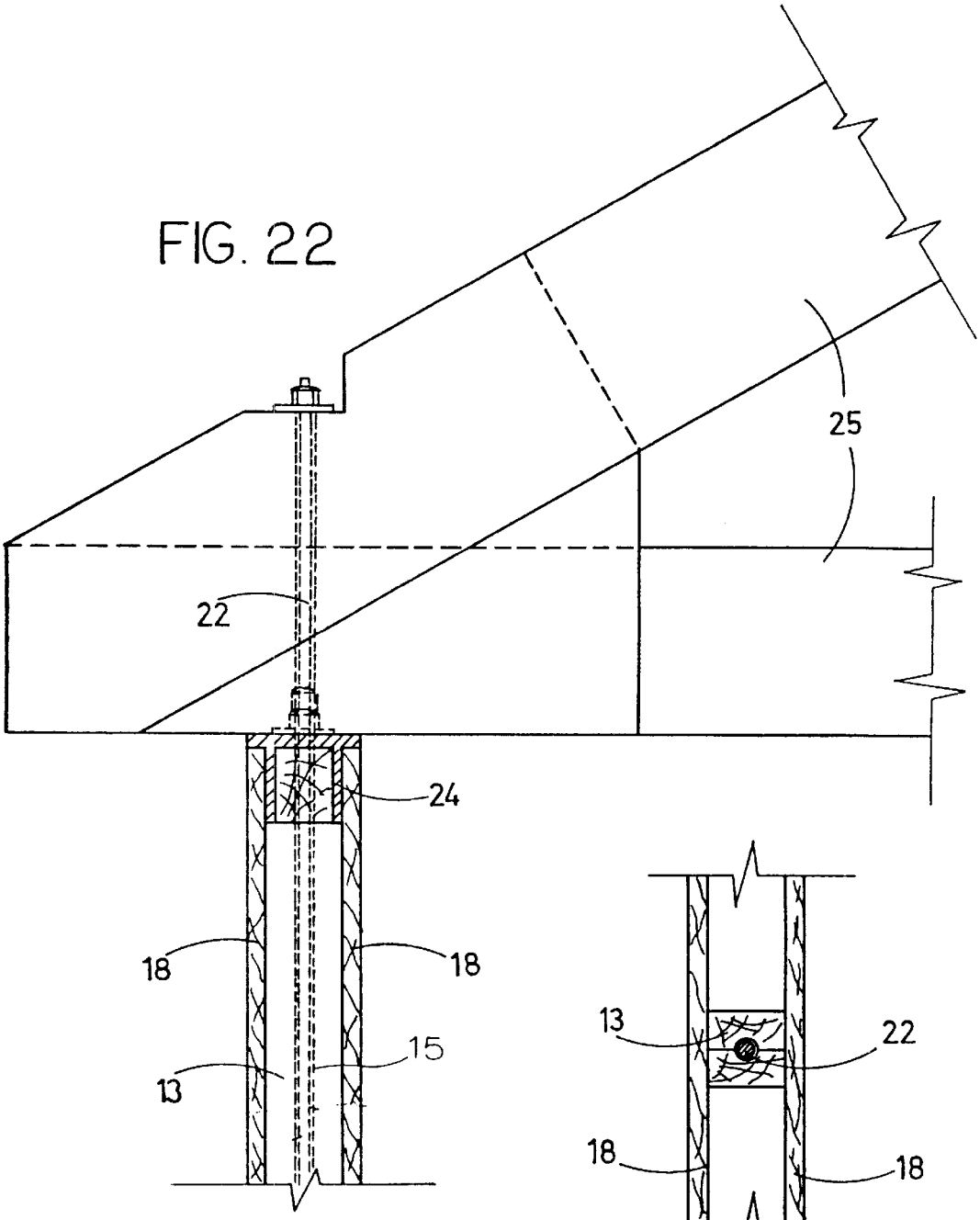

FIG. 22 is a vertical cross-section showing the wall structure and roof structure of the present invention having complement system that ends at the top of the roof support structure.

FIG. 23 is a horizontal cross-sectional view of the wood wall unit of the present invention below the roof structure.

It shows a wood stud comprised of two pieces of the same size. After being channeled, they are coupled by adhesive or by other mechanical fasteners.

Figure 24:
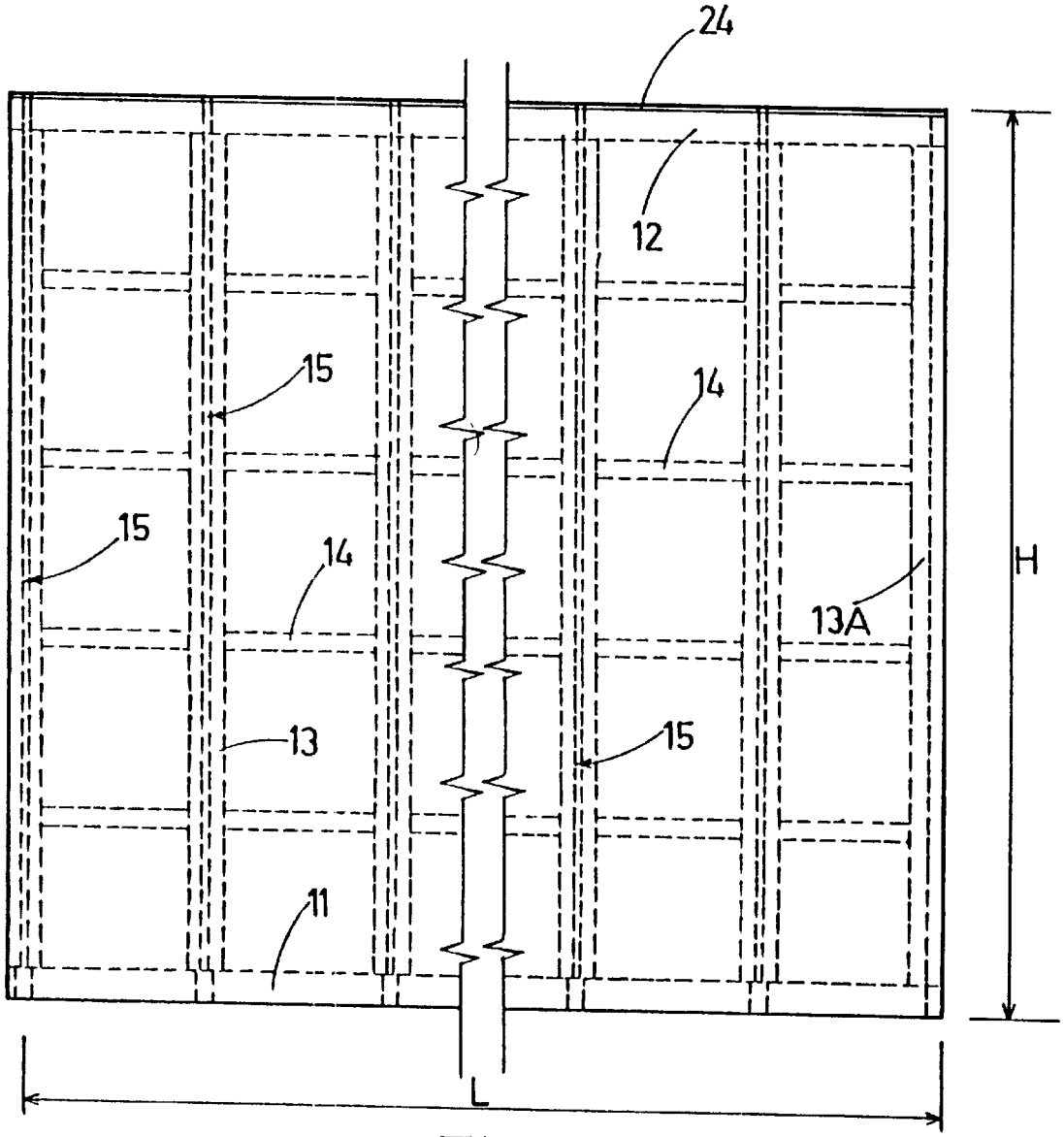

FIG. 24 is a fragmentary view of a wood wall panel of the present invention.

Figure 25:
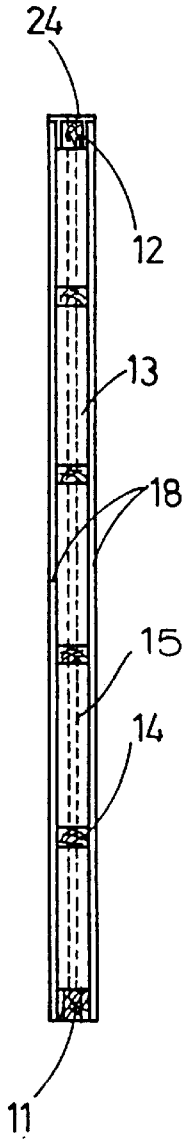

FIG. 25 is a vertical cross-section of the wall panel.

Figure 26:
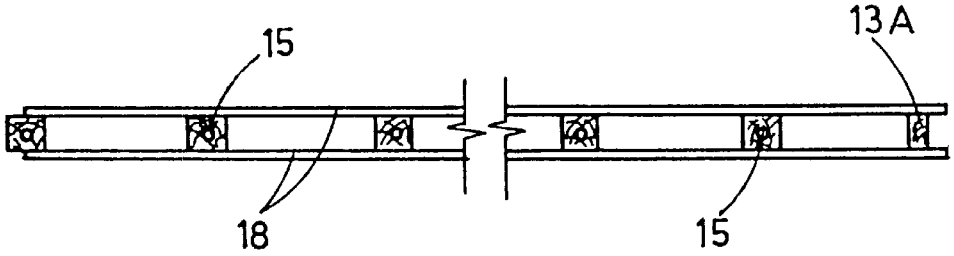

FIG. 26 is a horizontal cross-section of the wall panel.

Figure 27:
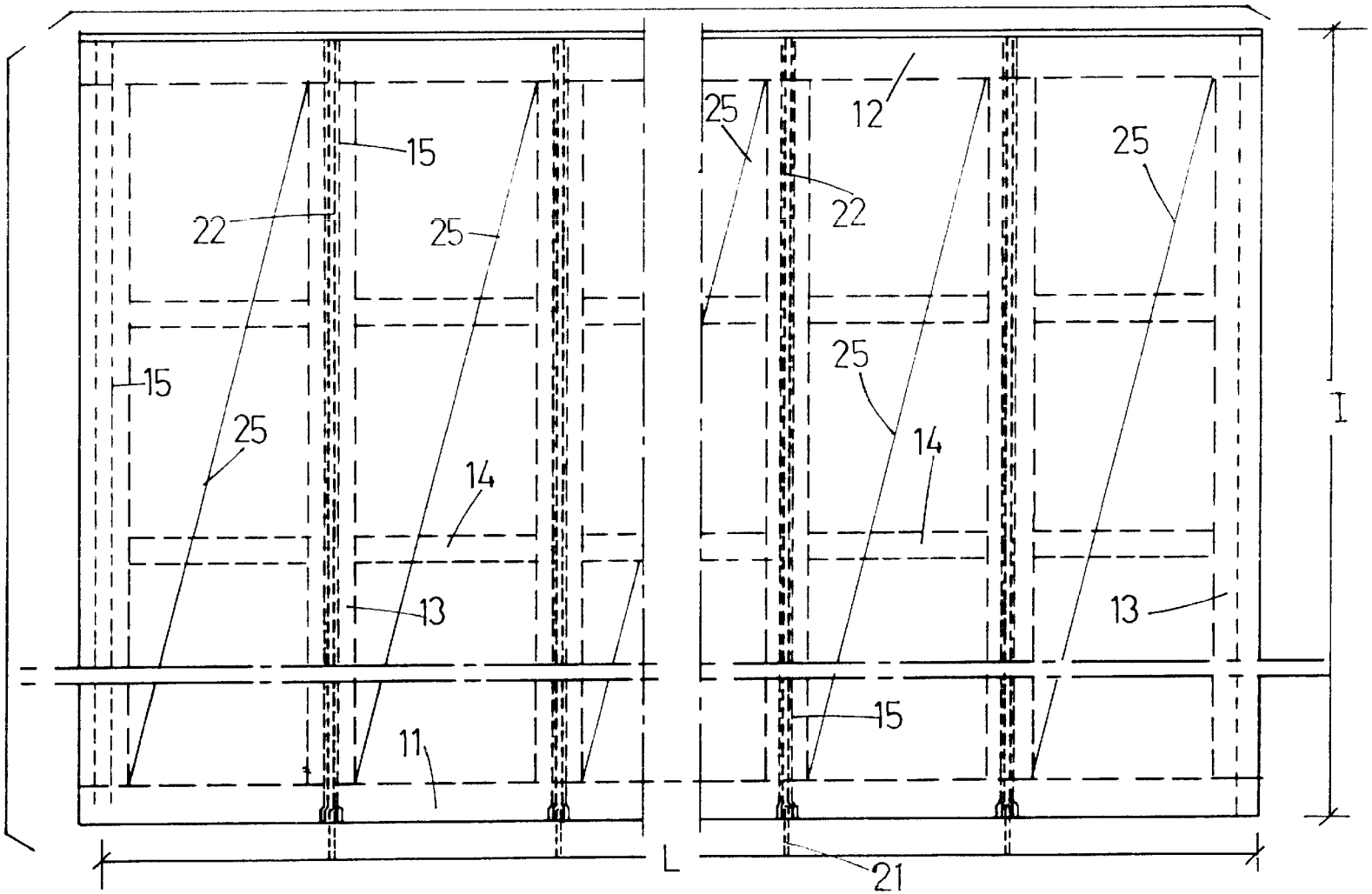

FIG. 27 is a fragmentary view of the structures designed for construction of buildings with heavyweight materials. There are two basic concepts of the structures:

first is the frame system comprised of columns 13 and beams 11, 12 and 14 built as reinforced concrete or steel structure, second is the massive wall system built as reinforced concrete throughout-25 with incorporated spaced hidden columns 13 and beams 11,12 and 14.

Meanwhile first system-frame system may be transferred partly or completely onto another wall system-wall panel system—when an empty fields between columns 13 and beams 11,12 and 14 are filled-up by panels 25 built by bricks, concrete blocks, stone, concrete or any prefabricated panels as concrete panels.

FIG. 27 shows that either system, frame system on its columns 13 or wall system in its incorporated spaced hidden columns 13 have the channels 15 running through the columns in the center of the cross-section of the columns. Strings 22 being cylindrical and having diameter lesser than the diameter of the channels are shown running trough the channels from the top of columns or walls to into foundation.

DETAILED DESCRIPTION OF THE PRESENT INVENTION

It is seen from TABLE NO.5, columns 3 and 4 that if reactive effects of relative gravity were included the amplitudes of displacement under wind load and seismic load action would approach zero, means the structure is in the state of a superior stability.

Note that in this particular analytic testing of a wall structure of the present invention, the wall unit is taken as Lambda=2 feet wide whereas the wall unit of the prior art shown in FIG. 8 and TABLE NO.2 was taken as Lambda= 1.33 feet(16 inches) wide. In general, the width of the wall(Lambda) is arbitrary.

Analytical testing of the structure given in the prior art and the structure of the present invention was made for the three story structures of FIGS. 3 and 11 having a size of 20 feet by 20 feet in a plan (i.e. width and length). However, the results depicted in TABLE NOS. 1–5 would be almost the same for any size building structure. Gravity displacement of a structure is greater for a greater area of a structure that is under wind pressure. The reason for this is as follows: there is disproportionality with respect to the increase of resulting forces of exerted wind load compared to the increase of the natural gravity of the structure in that the increase of resulting forces of exerted wind load is disproportionally greater. In other words, while the natural gravity of a wood structure increases only at negligible rate as the volume of the structure increases, the wind load grows much more rapidly.

In FIG. 24 , generally, the height of a panel is equal to the height of a story of the structure when assembled on site. The length of a panel may be arbitrary.

In order to accommodate incorporation of the new added structural components of the present invention, the existing structure is modified, namely by rearranging the framing in terms of the increased dimensions and spacing of the framing elements, namely the wall studs(or the columns for heavy materials). Vertical elements 13 of the framing system of the present invention are thereby capable of having the channel 15 incorporated in the center of its cross-section, as seen in FIGS. 12,13 and 27. In accordance with the present invention, for the structures made of any material these elements 13 called wood studs in FIGS. 12,13 and/or columns in FIG. 27 are channeled from the bottom to the top. Horizontal elements of the frame at the bottom and at the top of the wood wall are transformed from three to five elements designated by reference numerals 1 and 4 in structures of the prior art(see FIGS. 4 and 5) into one single element in the present invention, called a base beam 11 and top beam 12 of the wall panel depicted in FIG. 24.

An entire wall of the structure is made of wall panels shown In FIGS. 24–26, which are repeatedly used horizontally for one story structures and horizontally and vertically for two, three and larger story structures. The present invention allows for the option of assembling the wall panel in the plant and bringing it to the site assembled or else assembling it at the site piece by piece.

So that the wood wall made in accordance with the present invention are designed to carry load exerted by winds and earthquakes, they must be constructed so that their plywood sheeting 18 (or other material used, as described below) has equal thickness and equal quality on both sides of the frame system. This requirement applies for outside walls that are in contact with the wind as well as for internal walls that carry horizontal loads and which are located inside the space of the structure.

As seen in FIGS. 25 and 26, the wood wall of the present invention has absolute symmetry in both its vertical and horizontal cross-sections in order that the wall, structural units and material itself be able to accept load in the most convenient way. The most important property of the wall is increased capacity of the wall's mechanical characteristics, in terms of its ability to accept and accumulate enormous energy supplied first by the relative gravity force and then to accept, accumulate and disperse enormous energy exerted by external forces such as winds or earthquakes.

One of the advantages of the present invention is that the full capacity of the cross-sectional area of the wall structure is available for accepting, accumulating and dispersing energy. The full capacity of the cross-sectional area of the wall structure is available not only in the magnitude of allowable working stresses based on the nature of the material throughout the cross-sectional area but the force-carrying capacity is enlarged beyond what would otherwise be the natural elasticity of the material. This is accomplished by eliminating buckling of the walls. The walls made in accordance with the present invention from the foundation to the top of the roof do not suffer from slenderness and therefor 100% of the cross-sectional area of the wall structure is available to handle full loading of stresses that develop in the structure.

One of the primary features of the present invention is the insertion of a rebar, called a string 22, within cylindrical channels 15 through the studs 13 of the structure. The structural components of the complementary system of the wall structure depicted in FIGS. 15,15A,16 and 17 (string anchoring element 21, strings 22 and balance beam 24) represent a network consisting of an array of such strings 22 in the channels 15 of the studs and or columns 13 (with related spacing) as well as balance beams 24 running perpendicularly to the strings located at the top of the wall of each story of the structure. As seen in FIGS. 20 and 21, the strings 22 are solid rebars having round cross-section and having a female end at the bottom of the wall panel and a male end comprising a long thread above the top of the wall panel in order to accept a nut and a female end of the adjacent string 22 of the upper story. The balance beam 24 is relatively thin and lightweight and is a special shaped steel beam. Since the balance beam 24 runs around the building continuously, the sections are connected by welding.

The balance beam 24 has multiple purposes. First, it transfers concentric applied forces into uniform load on the wall. Second, when completely installed it represents a ring around the structure on every floor level. As such, it keeps the integrity of the structure in horizontal direction. As a result, a significant contribution to the structure's rigidity is added in both horizontal and vertical direction.

In addition overall integrity of structure of the building is in improved by present invention. In the prior art floor joist are attached to the wall using thin metal angles and nails. Or a number similar connections are used. In a high wind conditions the walls are easily teared off. In accordance with present invention the pair of floor joist 16 at FIGS. 12 and 13 have full overlap with the columns 13 and then connection is made rigid by bolts 17.

Figure 4:
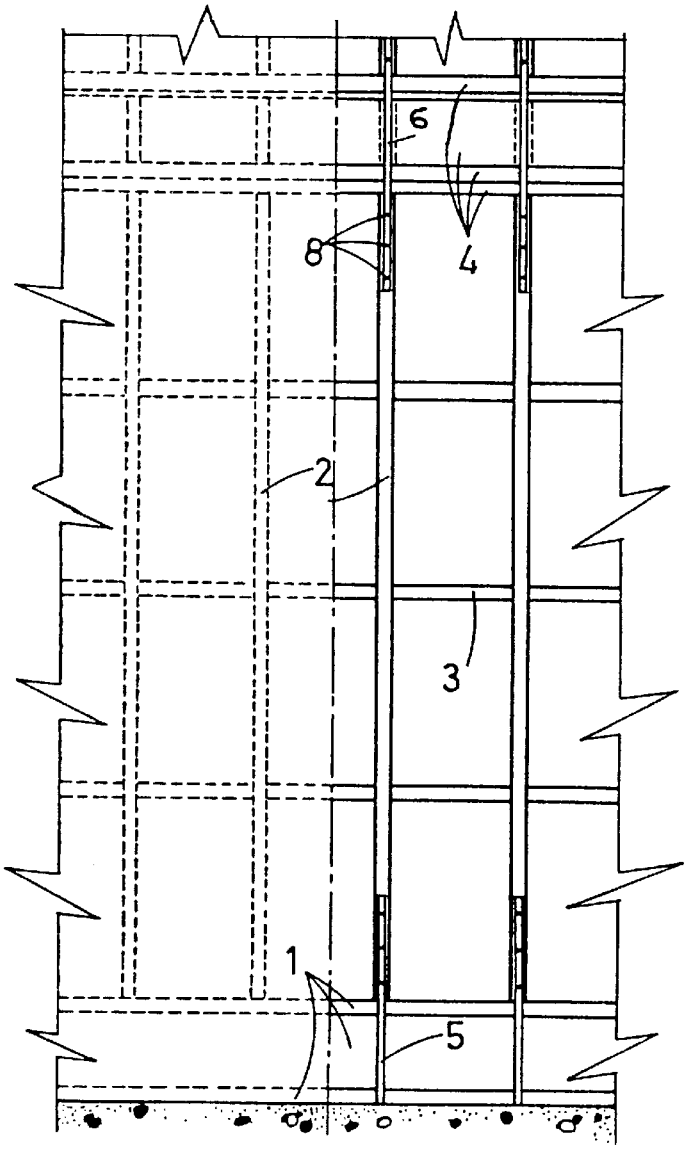
FIG. 4 (PRIOR ART)
FIG. 4 is a fragmentary view of the wall system of the prior art structures of FIGS. 1–3 with half covered by plywood sheeting and half having the plywood sheeting removed and showing the frame system 1,2,3, and 4.

As a result of the present invention's use of the complement system, the anemic fasteners and connectors that are used in prior art structures from the foundation up to and including a roof are entirely eliminated. For example, as seen in FIGS. 1 and 4 showing the prior art, the various metal straps 5,6 and nails 8 are used to provide integrity and to transmit forces. In the wall unit of the present invention, in contrast, nails are used in the framing system only to assemble elements and not to carry the load. The natural gravity load of the structures of the present invention and relative gravity load supplied by the complement system are transmitted to the foundation by the wall. Uplift load and tension forces due to uplift load are accepted by the vertical strings 22 of the complement system. The complement system is responsible for the vertical integrity of the structure under extreme conditions of the uplift forces because tension stress will never be allowed to appear in the wall along its height. While prior art walls have membrane-like vibration behavior in high wind conditions as evidenced by FIG. 8 and TABLE NO.2, this vibration is eliminated in the walls made in accordance with the present invention. For example, a wind speeds of 300 mph from a powerful tornado, the amplitude of vibrations of walls in prior art structures are 8 to 10 times greater than the allowable(of course the wall collapses much earlier than the calculated amplitude is achieved). In walls of the present invention, those amplitudes approach zero, as seen by FIG. 18 and TABLE NO.4. This is accomplished by the complement system and the stored stress-strain medium developed by the relative gravity force.

The modified structure and construction method thereof of the present invention is used in combination with the known methods of pre-stressing structures. A pre-stressing forces to create additional weight in the structure, which may be called "relative gravity", is applied at the top of the wall to the strings of the complement system by machinery such as calibrated hydraulic devices or other mechanical means such as power wrenches. Those pre-stressing forces are applied in direction that coincides with the direction of the structure's natural gravity. This develops in the wall the same stress-strain produced from the weight of walls built from heavier materials, such as bricks, stone or concrete. Similarly, using this method of pre-stressing structures, a one story wall, regardless of the material made of, can accumulate and store gravitational energy that is equal to gravitational energy of a same wall having 10, 20 or 30 stories. Accordingly, while walls made of wood normally weigh on the order of one fifth what walls made of bricks, stone or concrete weigh, using the method of pre-stressing to increase the relative gravity of the wood walls allows a wood wall to acquire more gravitational strength than walls made of classic heavyweight material, such as bricks, stone or concrete.

In sum, the weight of a dwelling house made of wood may be displaced from its natural position by high winds, as seen from FIG. 7 and TABLE NO.1 because the natural gravity of the structure is very small. When pre-stressing such structures, a complementary force, called a relative gravity force, is applied to the structure which compensates for the weight lacking in the structure thereby producing the greater resultant gravity force of the structure. The resultant gravity force is of sufficient intensity to be able, when dealing with wind, to return back onto or close to the original position of the structure, as seen in FIG. 14 and TABLE NO.3. The pre-stressing does not affect soil under the foundation and the force created by pre-stressing fills the structure and only the structure. This enhances structural stability.

While the present invention is most useful for residential and office structures that are designed and constructed of a lightweight material such as wood or aluminum, it should be understood that the present invention is also applicable in structures designed of any other material, including heavy materials such as steel, brick, stone, concrete, concrete blocks, and reinforced concrete. Accordingly, while the walls and other aspects of the modified structure of the present invention have been dominantly described in terms of wood structure, the same description is applicable to the structures made of other construction materials wherein columns of frame (or massive wall) would be used in place of wood studs, wood wall, etc.

This is well illustrated at FIG. 27 which represent the structure built of heavyweight materials herein mentioned.

The frame system comprised of columns 13 and beams 11,12 and 14 built as reinforced concrete or steel structure have incorporated the same complement system of strings 22 running through the channels 15 located in the center of the cross-section of the columns. An anchoring elements 21 are placed in foundation and aligned to be connected to the strings in the columns. The cylindrical strings have the solid annular cross-section af a diameter slightly lesser than diameter of the channels.

The space between frame elements, columns 13 and beams 11,12, 14 may be filled up by walls 25 built of any mentioned material.

When the structure is built as massive reinforced concrete wall, FIG. 27 the same frame system, columns 13 and beams 11, 12, 14 is incorporated onto walls as the hidden distinct structure inside the mass of walls. Now into hidden frame system the complement system is implemented so that channels 15 and strings 22 are located at the center of the cross-section of the hidden columns.

In addition, while the present invention is most useful for houses and office buildings, it is applicable also to pre-stressed freestanding structures of one or more stories including poles, piers, walls, columns, portals, television towers, industrial chimneys, obelisks, monuments, water towers, dams, highway supports, etc.

It is to be understood that while the apparatus and associated methods of this invention have been described and illustrated in detail, the above-described embodiments are simply illustrative of the principles of the invention. It is to be understood also that various other modifications and changes may be devised by those skilled in art which will embody the principles of the invention and fall within the spirit and scope thereof. It is not desired to limit the invention to the exact construction and operation shown and described. The spirit and scope of this invention are limited only by the spirit and scope of the following claims.

What is claimed is:

1. A building support structure for pre-stressed buildings of one or more stories made of lightweight material having modular wall panels throughout the structure from a foundation up to a roof, said wall panels made of wall frames that include vertical studs and horizontal beams and sheeting at both sides of the frames, said wall panels also having a height of a story and including strings inside channels running through studs from the top of the roof down into foundation, said strings being cylindrical and having a solid annular cross-section and having a female end at a bottom of the wall panels and having at a top of the wall panels a male end comprising a long thread for receiving a nut and a female end of adjacent strings, said strings having a strings anchoring element in the foundation and a balance beam running perpendicularly to the strings and located at a top of each wall panel and the long thread of said strings having a squared flat top at the top of the wall panels for being set against pre-stressing machinery, said studs each made of two equal pieces and having equal thickness on both sides of the channel and said wall panels having equal horizontal and vertical cross-sectional thicknesses.

2. The building support structure of claim 1, wherein the two equal pieces of the studs are coupled together using adhesive or mechanical fasteners and wherein the studs are spaced apart one from the other.

3. The building support structure of claim 1 wherein the lightweight material is wood.

4. A building support structure for pre-stressed buildings of one or more stories made of heavy material having modular wall frames filled in by walls throughout the structure from a foundation up to a roof, said wall frames made of spaced columns and beams located at each floor level including the strings inside channels running through columns of frames from the top of the roof to into the foundation, said strings being cylindrical and having a solid annular cross-section of a diameter lesser than the diameter of the channels and having a female end at a bottom of columns of the frames and having at a top of the columns of frames a male end comprising a long thread for receiving a nut and a female end of adjacent strings, said strings having a strings anchoring element in the foundation and a balance beam running perpendicularly to the strings and located at a top of each column of the frames and the long thread of said strings having a squared flat top at the top of the columns for being set against pre-stressing machinery, said columns and walls being spaced and having equal thickness on both sides of the channels and said columns and walls having equal horizontal and vertical cross-sectional thicknesses.

5. The building support structure of claim 4 wherein the heavy material is at least one of steel and reinforced concrete.

6. A method of constructing buildings of one or more stories made of lightweight material to increase their resistance to strong winds and earthquakes, comprising:

constructing on a foundation modular wall frames of wall panels having a height of a story and having equal cross-sectional thicknesses of all elements of the frames, for each story constructing modular wall frames of wall panels having a height of a story and having equal cross-sectional thicknesses of all elements of the frames by constructing spaced studs with channels wherein two equal pieces of the studs are coupled together by adhesive or by mechanical fasteners and such studs having equal thickness on both sides of the channels, and constructing spaced beams as base beam and top beam of the frames and having equal thickness as the studs, constructing plywood sheeting of equal thickness and equal quality at both sides of the wall frames constructing a cylindrical strings having a solid annular cross-section of a diameter lesser than the diameter of the channels and having a female end at a bottom of the wall panels and having at a top of the wall panels a male end comprising a long thread for receiving a nut and a female end of adjacent strings, the long thread of said strings having a squared flat top at the top of the wall panels for being set against pre-stressing machinery, placing the strings inside the channels running through the studs so that the studs are running from the top of the structure to the foundation, constructing and placing the strings anchoring element in the foundation to be connected to adjacent strings of panels installed on foundation ,and by constructing and placing a steel balance beam running perpendicularly to the strings and located at the top of each wall panel, pre-stressing each panel at each story by using known devices to apply forces to the strings at the top of the panels in a direction of the natural gravity force of the building being constructed to create relative gravity in the structure, and constructing a roof on the top of the highest story by having strings end at the top of roof structure and having relative gravity forces in the highest story being applied at the top of roof structure.

7. A method of constructing buildings of one or more stories made of heavy material and combined of frames and walls to increase their resistance to strong winds and earthquakes, comprising:

constructing on foundation modular wall frames made of spaced columns and horizontal beams at each floor level and constructing walls having a height of a story and having equal horizontal and vertical cross-sectional thicknesses, for each story constructing modular panels by constructing wall frames made of spaced columns and beams and constructing walls having a height of a story and having equal horizontal and vertical cross-sectional thicknesses by constructing columns of frames a with channel in the middle of cross-section of each column and constructing walls having the spaced channels and having equal thickness on both sides of the channels, constructing cylindrical strings having a solid annular cross-section of a diameter lesser than diameter of the channels and having a female end at a bottom of the columns of the frames and walls and having at a top of the columns of frames and walls a male end comprising a long thread for receiving a nut and a female end of adjacent strings, the long thread of said strings having a squared flat top at the top of the columns of frames and walls for being set against pre-stressing machinery, placing the strings inside channels running through the columns of frames and walls so that the columns of frames and walls are running from the top of the structure to the foundation, constructing and placing the strings anchoring elements in the foundation to be connected to adjacent strings of the columns and walls and by constructing and placing a balance beam running perpendicularly to the strings and located at a top of each column of frames and walls, pre-stressing each column of frames and walls at each story by using known devices to apply forces to the strings at the top of columns and walls in a direction of the natural gravity force of the building being constructed to create relative gravity in the structure, and constructing a roof on the top of the highest story and having strings end at the top of roof and having relative gravity forces in the highest story being applied at the top of roof structure.

8. The building support structure of claim 7 wherein the heavy material is at least one of steel and reinforced concrete.

9. A building support structure for pre-stressed buildings of one or more stories made of heavyweight material and having a frame system throughout the structure from a foundation up to the roof, designed to increase their resistance to strong winds and earthquakes, said frame system having a height of one or more stories, said building support structure formed by:

constructing on foundation modular frames made of spaced columns and beams located at each floor level, and columns of the frames having the channels running from the top of the roof down to the foundation by constructing a channel in each column of frames located in the middle of the cross-section of the column and placing strings into the channels of the columns of the frames said strings being cylindrical and having a solid annular cross-section of a diameter lesser than diameter of channels and having a female end at a bottom of a columns of frames and having at a top of the columns a male end comprising a long thread for receiving a nut and a female end of adjacent strings said strings having a strings anchoring element in the foundation connected to adjacent strings in columns and having a balance beam running perpendicularly to the strings and located at a top of each column of frames and the long thread of said strings having a squared flat top on the top of the columns of frames for being set against pre-stressing machinery, said columns of frames being spaced and having equal thickness on both sides of the channels, pre-stressing each column of frames at each story by applying forces to the strings at the top of columns in direction of the natural gravity force of the building being constructed to create relative gravity in the structure, and constructing a roof on the top of the highest story and having strings end at the top of the roof and having relative gravity forces in the highest story being applied at the top of the roof structure.

10. The building support structure of claim 9 wherein the heavyweight material is steel.

11. The building support structure of claim 9 wherein the heavyweight material is reinforced concrete.

12. A building support structure for pre-stressed free-standing structures of one or more stories made of heavyweight material having modular wall frames and walls throughout the structure from foundation up to a roof, said wall frames made of beams and columns having a height of a story and having the channels inside columns located in the middle of cross-section of the columns and spaced channels in the walls running from the top of the structure to the foundation, said channels in columns and walls having strings running from the top of the structure to into foundation, said strings being cylindrical and having a solid annular cross-section of a diameter lesser than a diameter of the channels and having a female end at a bottom of columns and walls and having at a top of the columns and walls a male end comprising a long thread for receiving a nut and a female end of an adjacent strings, said strings having a strings anchoring element in the foundation connected to adjacent strings and a balance beam running perpendicularly to the strings and located at a top of each column and wall and the long thread of said strings having a squared flat top at the top of the columns and walls for being set against pre-stressing machinery, said columns and walls being spaced and having equal thickness on both sides of the channels, pre-stressing each column of frames and wall at each story by applying forces to the strings at the top of columns and walls in direction of the natural gravity force of the building being constructed to create relative gravity in the structure.

13. The building support structure of claim 12 wherein the heavyweight material is steel.

14. The building support structure of claim 12 wherein the heavyweight material is reinforced concrete.

* * * * *